US009343286B2

(12) United States Patent
Dabringhauusen et al.

(10) Patent No.: US 9,343,286 B2
(45) Date of Patent: May 17, 2016

(54) LAMP WITH ELECTRICAL COMPONENTS EMBEDDED IN AN INSULATION COMPOUND

(71) Applicant: KONINKLIJKE PHILIPS N.V., Eindhoven (NL)

(72) Inventors: Lars Dabringhauusen, Baesweiler (DE); Juergen Gerhard Mertens, Aachen (DE); Anton Duschl, Hauzenberg (DE)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 14/397,331

(22) PCT Filed: Apr. 12, 2013

(86) PCT No.: PCT/IB2013/052929

§ 371 (c)(1),
(2) Date: Oct. 27, 2014

(87) PCT Pub. No.: WO2013/160794

PCT Pub. Date: Oct. 31, 2013

(65) Prior Publication Data

US 2015/0145412 A1 May 28, 2015

Related U.S. Application Data

(60) Provisional application No. 61/639,113, filed on Apr. 27, 2012.

(51) Int. Cl.

| | |
|---|---|
| ***H01J 61/54*** | (2006.01) |
| ***H01J 5/54*** | (2006.01) |
| ***H01J 5/56*** | (2006.01) |

(Continued)

(52) U.S. Cl.
CPC . *H01J 61/54* (2013.01); *H01J 5/54* (2013.01); *H01J 5/56* (2013.01); *H01J 9/30* (2013.01); *H01J 61/30* (2013.01); *H01J 61/56* (2013.01); *F21S 48/1104* (2013.01); *F21S 48/1186* (2013.01)

(58) Field of Classification Search
CPC ..... H01J 61/54; H01J 61/56; H01J 61/30; H01J 9/30; H01J 5/54; H01J 5/56; F21S 48/1189; F21S 48/1104
See application file for complete search history.

(56) References Cited

U.S. PATENT DOCUMENTS 5,659,423 A * 8/1997 Schierbeek ..... B60R 1/0602 359/602
6,462,476 B1 10/2002 Hirschmann et al.

(Continued)

FOREIGN PATENT DOCUMENTS

DE 102007037635 A1 2/2009
EP 2025993 A2 2/2009

(Continued)

*Primary Examiner* — Anne Hines

(57) ABSTRACT

A lamp (10) is described comprising a burner (14) fixed to a lamp base (12). The lamp base (12) includes a top wall oriented towards the burner (14). Within the top wall, an opening (28) is provided. The lamp base (12) further comprises an insulation chamber (42) where an electrical component, e. g. a transformer (54), is embedded within an insulation compound (43). In order to prevent possibly spilled insulation compound from leaking through the opening (28), a raised retention wall (46) is provided around the opening.

13 Claims, 5 Drawing Sheets

(51) Int. Cl.

| | |
|---|---|
| ***H01J 9/30*** | (2006.01) |
| ***H01J 61/30*** | (2006.01) |
| ***H01J 61/56*** | (2006.01) |
| *F21S 8/10* | (2006.01) |

(56) References Cited

U.S. PATENT DOCUMENTS

| | | | | |
|---|---|---|---|---|
| 6,731,076 | B1 | 5/2004 | Gerhard et al. | |
| 2009/0047831 | A1* | 2/2009 | Yashiki | F21S 48/1104 439/620.02 |
| 2009/0053935 | A1* | 2/2009 | Takahashi | F21S 48/1109 439/620.02 |
| 2010/0141145 | A1 | 6/2010 | Batz et al. | |
| 2011/0115374 | A1 | 5/2011 | Sroka | |

FOREIGN PATENT DOCUMENTS

| | | | |
|---|---|---|---|
| WO | 2007110318 | A1 | 10/2007 |
| WO | 2013160784 | A1 | 10/2013 |
| WO | 2013160797 | A1 | 10/2013 |

* cited by examiner

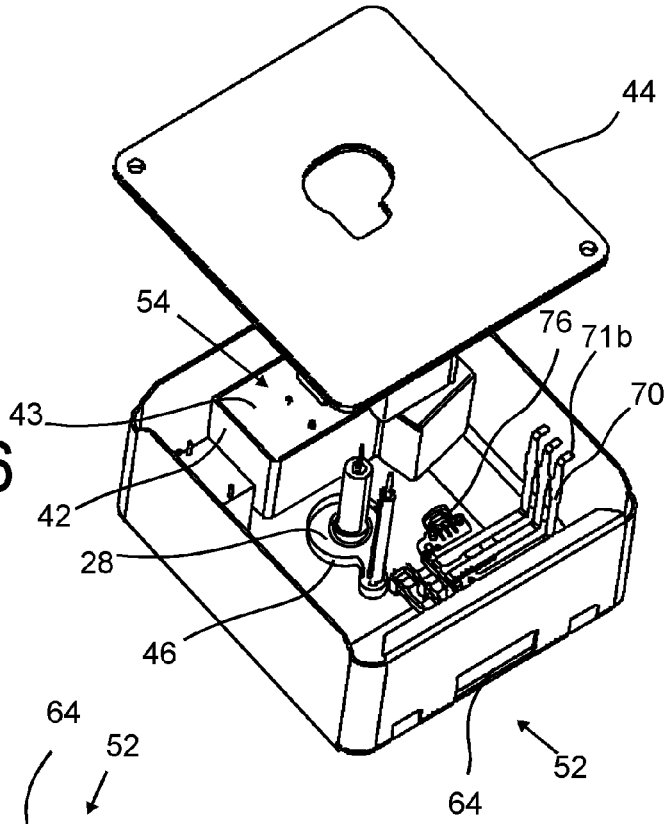
FIG. 6
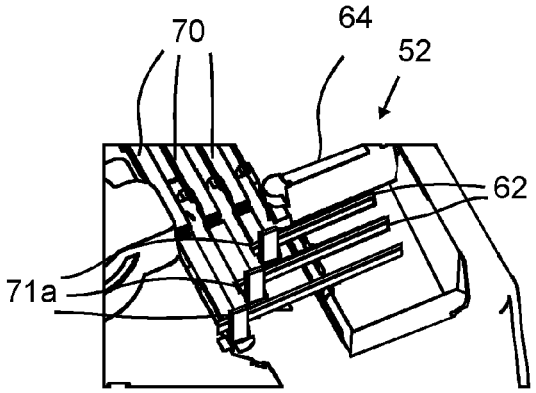
FIG. 7
FIG. 9
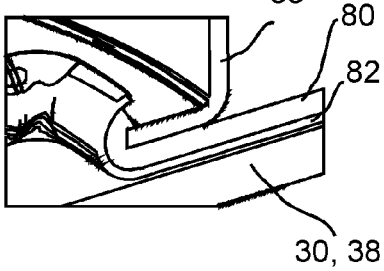
FIG. 8
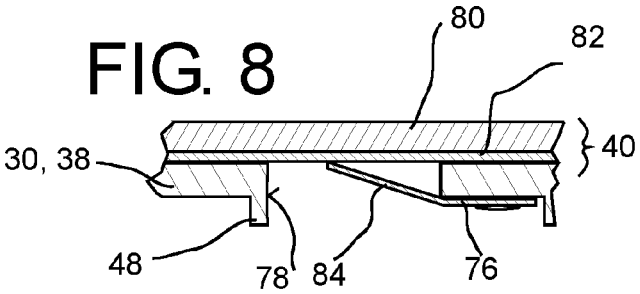

LAMP WITH ELECTRICAL COMPONENTS EMBEDDED IN AN INSULATION COMPOUND

CROSS-REFERENCE TO PRIOR APPLICATIONS

This application is the U.S. National Phase application under 35 U.S.C. §371 of International Application No. PCT/IB2013/052929, filed on Apr. 12, 2013, which claims the benefit of U.S. Provisional Patent Application No. 61/639,113, filed on Apr. 27, 2012. These applications are hereby incorporated by reference herein.

FIELD OF THE INVENTION

The present invention relates to a lamp and a method of manufacturing a lamp, in particular to a discharge lamp, and more specifically to a lamp for use in a vehicle headlight.

BACKGROUND OF THE INVENTION

Electrical discharge lamps, in particular high intensity discharge (HID) lamps are widely used today, e. g. in vehicle headlights. While first generations of such automotive HID lamps comprised a lamp base only for mechanical mounting and electrical contacting of a burner, currently developed lamps include circuitry for operation and/or ignition of the burner integrated within the lamp base.

Some components, which may be used e. g. for delivering a high voltage for ignition of an arc discharge within the burner require special electrical insulation. For especially good electrical insulation, electrical components, in particular a transformer, have been "potted", i. e. embedded within a surrounding insulation compound.

US 2010/0134010 A1 describes a gas discharge lamp with a burner fixed to a lamp base consisting of electrically conductive or metalized plastic, or by plastic enclosed in an electrically conductive casing, e. g. made from aluminum, magnesium or brass. The base is closed by a base plate consisting of a material well conductive thermally as well as electrically, such as aluminum or magnesium. In the interior of the base, ignition electronics including an ignition transformer and operation electronics are provided. An electrically conductive shielding surface is established between the ignition electronics and the operation electronics by a metallic sheet inserted between two circuit boards, connected to the electrically conductive casing. Remaining hollow chambers within the casing, in particular around the ignition transformer, are filled with a casting compound to prevent electrical flashover due to the high voltage created by the ignition transformer, and also for de-heating of the electronics and for providing a mechanically sturdy unit.

SUMMARY OF THE INVENTION

It may be considered an object to provide a lamp and a manufacturing method therefor allowing to easily provide good insulation without adverse effects during later operation of the lamp.

This object is solved by a lamp according to claim 1 and by a method for manufacturing a lamp according to claim 11. Dependent claims refer to preferred embodiments of the invention.

The present inventors have considered the practice of "potted" electrical components within the lamp base and have found that insulation compounds used may have detrimental effects during operation of the lamp if not handled properly.

In particular, many insulating compounds comprise silicone, which may evaporate due to the high operation temperatures and intense radiation from the burner. Evaporated silicone entering the reflector may lead to whitening thereof, as well as to a reaction with anti-condensation coatings. The inventors have therefore found that it is essential to prevent the insulation compound from entering the front portion of the lamp base, oriented towards the reflector. This may be difficult to achieve, since many insulation compounds well suited for potting of components are provided in a very liquid state and are not easy to handle during the manufacturing process.

According to the invention, the lamp comprises a burner, in particular with a discharge vessel for generating an electrical arc discharge, fixed to a lamp base. The lamp base comprises a housing, with a top wall element oriented towards the burner, and at least one opening within the top wall element. Within the base, at least one insulation chamber is arranged, where an electrical component of an operating circuit, in particular a transformer, is embedded within an insulation compound.

In order to avoid, at the time of the production, leakage of insulation compound through the top wall and towards the burner, a raised retention wall is provided around the opening. Preferably, the raised retention wall extends from the top wall in the same direction as the insulation chamber, e. g. at least substantially rectangular.

In the manufacturing method according to the invention, the insulation chamber is filled at least partially with the insulation compound, thereby embedding the electrical component (e. g. transformer). In particular if the insulation chamber is oriented facing from the top wall in a direction away from the burner, and is filled in "upside down" orientation, i. e. with the burner oriented downwards (and the top wall beneath the insulation chamber), the raised retention wall provided around the opening in the top wall prevents insulation compound spilled from the chamber to leak through the opening.

Thus, the raised retention wall facilitates the manufacture of lamps with "potted" components. In the event of insulation compound spilled from the insulation chamber, the spilled insulation compound does not easily leak through the opening to enter the critical part of the lamp exposed to the burner, but is contained by the retention wall.

A retention wall has proven to be a simple measure, yet effective to prevent potential problems with insulation compound leaking towards the exposed front portion of the lamp.

One opening in the top wall, which is preferably surrounded by a raised retention wall, is an opening through which the burner protrudes from the lamp base. It is possible that more than one opening is provided in the top wall. For example, further openings in the top wall may be provided for a back contact (electrical conductor to the burner), or for an electrical ground contact. It is preferred to provide a raised retention wall for each of the openings provided within the top wall.

According to a preferred embodiment of the invention, the lamp base comprises a holder element, which is preferably made out of an electrically insulating material. The holder element may comprise the top wall and the opening, and may include—preferably in one piece with the holder element—the raised retention wall. Further, it is preferred that the holder element includes at least side walls for the insulation chamber. A corresponding holder element may easily be manufactured e. g. from a plastic material and include both the insulation chamber and the retention walls. It is further preferred that the holder element is arranged within an outer metal housing.

In a preferred embodiment, an electronic operating circuit is arranged within the base to supply electrical power to the burner. The operating circuit may comprise an ignition circuit for providing a high ignition voltage to the burner, or a driver circuit for providing electrical power for operation of the burner, or, preferably, both.

According to a preferred embodiment of the invention, a metal shield element is provided within the lamp base to shield electrical components of the operating circuit. In particular the high voltage required for ignition of an arc discharge in the burner may create electromagnetic interference (EMI). The metal shield element serves to protect sensitive components, such as e. g. semiconductor components, from EMI. The metal shield element may preferably be provided between a transformer and/or a core component and other components of an electric operating circuit for the burner.

Further, the housing may comprise a plug/socket connector electrically connected to contact path elements extending within the housing. A metal shield may be arranged to at least partly cover the plug/socket connector and/or the contact path element, in order to prevent EMI from spreading via the electrical connection.

In manufacturing the lamp according to the invention, it is preferred to provide the insulation compound, preferably a silicone-containing insulation compound, in a fluid state. The insulation compound may be filled into the insulation chamber in the fluid state, thereby allowing easy handling and ensuring that the "potted" component will be fully embedded. In case of amounts of spillage, the fluid compound will be retained by the retention wall. In a later curing treatment, the liquid compound is cured, e. g. by heating, to adopt a firm state. This applies to the compound within the insulation chamber as well as to any potential spillage retained by the retention wall. After the curing treatment, due to the now firm state of the insulation compound, there is no further risk of compound leaking to the exposed front parts of the lamp, irrespective of the later orientation of the lamp during operation.

BRIEF DESCRIPTION OF THE DRAWINGS

These and other aspects of the invention will be apparent from and elucidated with reference to the embodiments hereinafter.

In the drawings,

FIG. 6 shows a perspective exploded view of parts of the lamp of FIG. 1-5;

FIG. 7 shows a perspective view of parts of the lamp of FIG. 1-6;

FIG. 8 shows a partial sectional view of the lamp of FIG. 1-7;

FIG. 9 shows a sectional perspective view of parts of the lamp of FIG. 1-8 with the section along A . . . A in FIG. 1;

DESCRIPTION OF EMBODIMENTS

Figure 1:
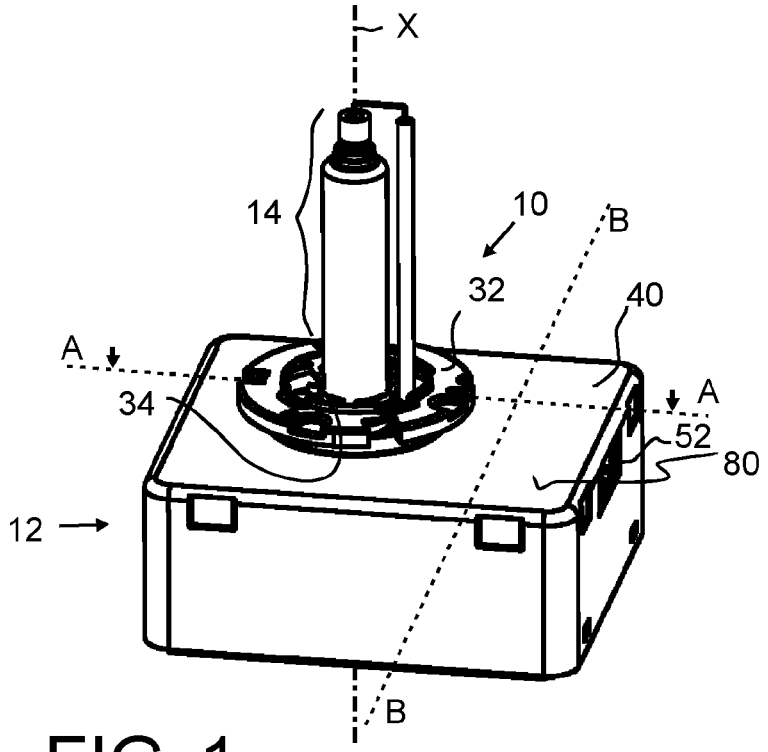
FIG. 1 shows a perspective view of an embodiment of an automotive HID lamp.

FIG. 1 shows a lamp 10 including a lamp base 12, from which a burner 14 protrudes.

Figure 2:
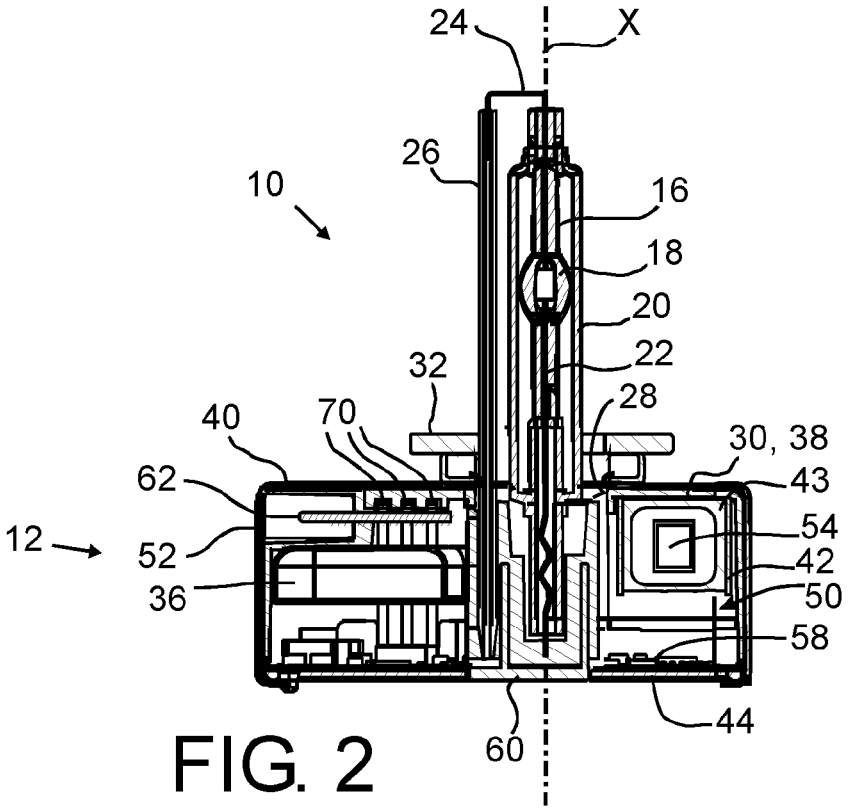
FIG. 2 shows a sectional view of the lamp of FIG. 1 with the section along A. . . A in FIG. 1.

As visible in particular from the cross-sectional view of FIG. 2, the burner 14 is comprised of a burner tube 16 forming a discharge vessel 18 with an enclosed discharge space and an outer bulb 20 arranged around the discharge vessel 18. The outer bulb 20 and the burner tube 16 with the discharge vessel 18 are made of quartz glass material. Within the discharge space, which comprises a filling of metal halides and Xenon, a first and second electrode are provided. The first electrode is electrically connected to a first, central contact lead 22 extending within the burner tube 16 into the housing 12. A second electrode is connected to a return contact lead 24 extending in parallel to the longitudinal axis X of the burner 14. A ceramic tube 26 is arranged around the return contact lead 24 for insulation.

The burner 14 is mechanically held relative to the lamp cap housing 12 by a holding ring structure 32 provided around the burner 14, fixed to a collar of the burner 14 by spot-welded spring tongues.

The lamp base 12 comprises a metal outer housing 40, an inner housing holder element 30, and a bottom plate 44. All of the outer housing wall elements 40, 44 are made out of aluminum as a metal material of good heat conduction properties. The inner holder element 30 is made out of a plastic material.

Within the lamp base 12, electrical components of a lamp operating circuit 50 are arranged. The lamp operating circuit 50 is supplied with electrical power from an electrical plug/socket connector 52 opening to the side of the lamp base 12. For use in a motor vehicle headlamp, the lamp 10 is electrically connected to onboard electrical power and to ground via the connector 52. The lamp operating circuit 50 integrated within the lamp base 12 provides all circuitry required to adapt the voltage supplied at connector 52 to the type of electrical driving voltage and current required for the operation of the burner 14 during ignition, following run-up and steady-state operation. The lamp operating circuit 50 comprises on a printed circuit board 58 and connected thereto circuitry and electrical components for ignition and operation of the lamp 10 as well as a microcontroller for controlling operation of to the burner 14.

Figure 3:
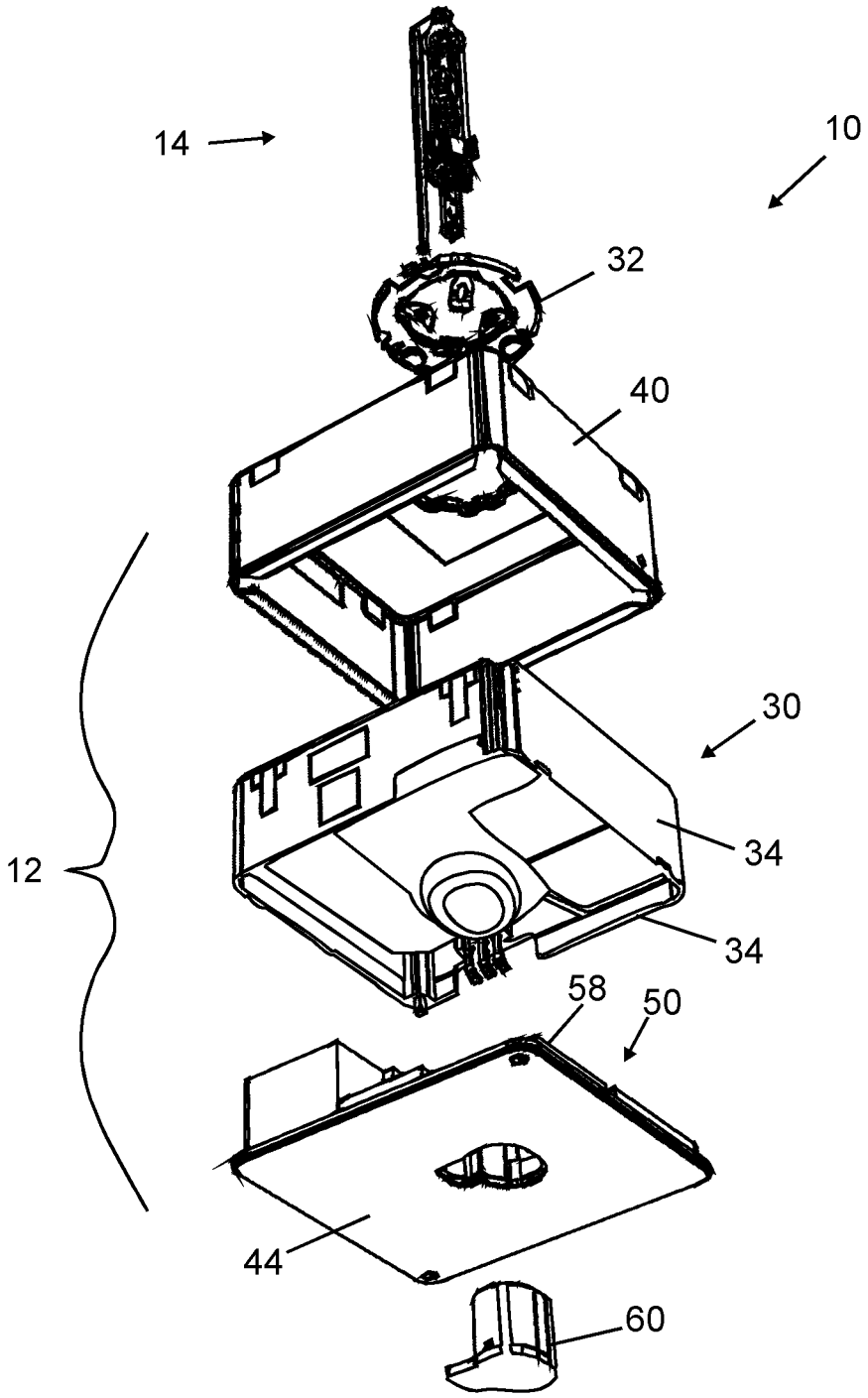
FIG. 3 shows an exploded view of the lamp of FIG. 1, FIG. 2.

As visible from the exploded view shown in FIG. 3 (where some internal parts within the base are not shown for better understanding), the plastic holder 30 is enclosed within the aluminum housing 40. As will be explained below, the holder 30 serves for mounting a plurality of components of the lamp operating circuit 50, such as a transformer and the electrical plug/socket connector 52. The holder 30 further holds electrical contacts of these components. The holder 30 is substantially box-shaped with side walls 34 and a top wall 38. The top wall 38, as shown in FIG. 2, is oriented towards the burner 14, covered by the metal housing 40.

As visible in particular from the cross-sectional view of FIG. 2, the burner 14 is mounted at a central opening 28, and is arranged to protrude quite a distance axially along the longitudinal axis X into the lamp base 12. The result of the corresponding arrangement of the burner 14 quite deep within the lamp base 12 leads to a reduced light center length (LCL), i.e. distance between the center of the discharge vessel 18 relative to the holding ring 32 comprising position reference elements for relative positioning within a reflector of a motor vehicle headlight unit.

As the burner 14 is thus installed to protrude into the lamp cap housing 12, the electrical contact leads from the burner 14, namely the central contact lead 22 and return contact lead 24, also extend into the lamp cap housing 12. In operation of the lamp 10, and in particular during ignition, insulation needs to be provided to prevent flashover between the electrical contact leads 22, 24 as well as from any of the contact leads 22, 24 to components or contact leads of the lamp operating circuit 50 or parts of the lamp cap housing 12. In order to provide this insulation, a plastic cap 60 is provided, covering the central contact lead 22 and the return contact lead 24 axially. The cap 60 serves to provide electrical insulation, in particular between the central contact lead 22 and return contact lead 24, but also between the contact leads 22, 24 and the metal bottom plate 44.

Components of the lamp operating circuit 50 are arranged on a printed circuit board 58 provided within the lamp base 12, holding and electrically interconnecting the electrical circuit components provided thereon. The printed circuit board (PCB) 58 with electrical components mounted on a top surface is arranged directly on the bottom plate 44. Thus, there is close thermal contact between the lamp operating circuit 50 and the bottom plate 44, so that the bottom plate 44 serves as heat sink.

The operating circuit 50 arranged within the base 12 comprises all necessary circuitry, such that the lamp 10 for all modes of operation requires only connection to the onboard voltage of a motor vehicle, which may be supplied at the plug/socket connector 52. The operating circuit 50 includes an ignitor for supplying a high voltage to the burner 14 for igniting an arc discharge within the discharge vessel 18. The operating circuit further comprises a driver circuit for generating an alternating current for operation of the burner 14 in a run-up period after ignition and in subsequent steady-state operation. The operating circuit 50 comprises a micro-controller for control of the operation of the components of operating circuit 50 and of the burner 14.

As shown in FIG. 7, the plug/socket connector 52 comprises three contacts 62 protruding within a socket cavity 64 formed within the holder element 30. One of the contacts 62 is a ground contact, connecting the lamp 10 to electrical ground of the vehicle onboard electrical system. The other contacts are provided for a supply voltage (onboard voltage of the vehicle, e.g. 12 V) and for transmitting communication control signals from an electronic control unit (ECU) on board of the vehicle to the micro-controller of the operating circuit 50 and vice versa.

FIG. 4-7 show how the electrical contacts 62 of the plug/socket connector 52 are connected to the PCB 58 via contact path elements 70, which are held by the holder 30.

Figure 4:
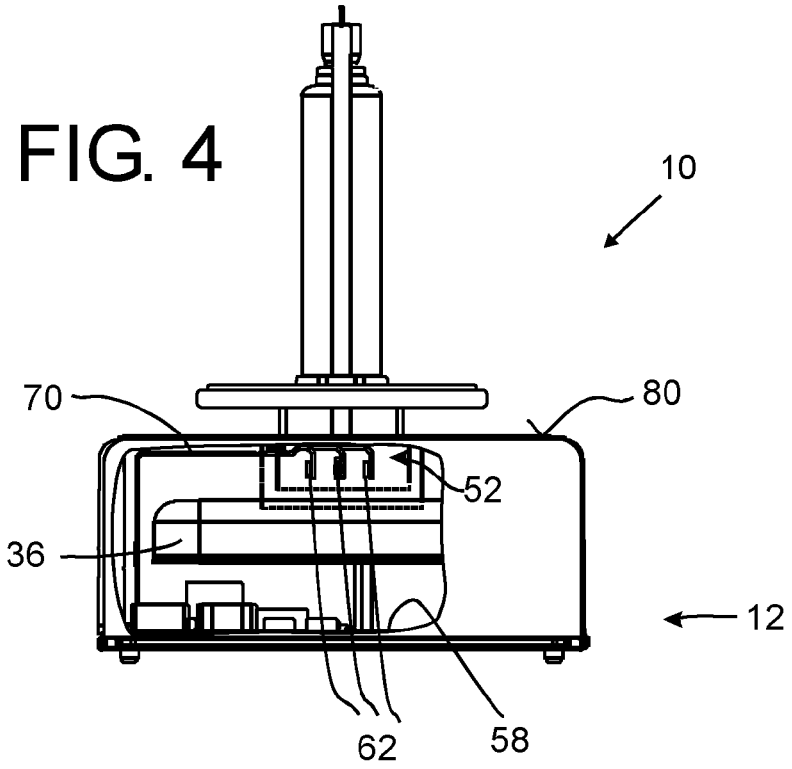
FIG. 4 shows a side view of the lamp of FIG. 1-3 with a partially cut-away housing.

The contact path elements 70 are flat, elongate metal strips or webs. Corresponding to the three contacts 62 of the plug/socket connector 52, there are three contact path elements 70 arranged in parallel within the base 12, extending from the connector 52 to the PCB 58. The contact path elements 70 are bent roughly L-shaped, as shown in FIG. 4 (where the holder 30 is not shown), FIG. 5. Both ends of the contact path elements 70 are bent to form contact flaps 71*a*, 71*b* for contacting the electrical contacts 62 of the connector 52 and for contacting contact surfaces of the PCB 58. Each contact flap 71*a* of the contact path element 70 is fixed to one plug contact 62 via spot welding, and each contact flap 71*b* is fixed to one contact surface 72 by soldering.

Figure 5:
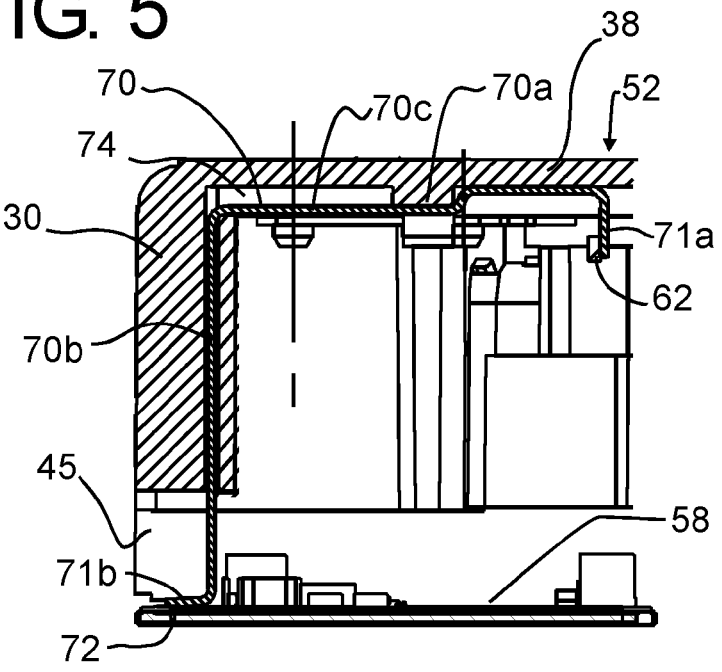
FIG. 5 shows an enlarged partial sectional view of the lamp of FIG. 1-4 with the section along B . . . B in FIG. 1.

As visible from FIG. 4, FIG. 5 (where the metal outer housing 40 is not shown), the contact path elements 70 extend from the connector 52 in a first portion 70*a* substantially in parallel to the upper surface of the base 12, oriented towards the burner (i. e. horizontally in FIG. 4, FIG. 5.). The first portion 70*a* of the contact path elements 70 is fixed to the holder 30 by partly embedding the first portion 70*a* of the contact path elements 70 within the plastic material.

The contact path elements 70 are bent at an angle of about 90° to continue as a second section 70*b* towards the PCB 58, i. e. substantially in parallel to the longitudinal axis X of the lamp 10. The second section 70*b* of the contact path elements 70 is held and guided by the holder 30, but not fixed thereto. The holder 30 provides an elongate opening, through which the second section 70*b* of the contact path elements 70*a* protrudes, such that each of the metal webs is surrounded by the plastic material of the holder 30 in traverse directions. Thus, the second section 70*b* of the contact path elements 70 is slidably received within the opening of the holder 30, such that it is movable in longitudinal direction while being guided in traverse direction by the enclosing plastic material.

During assembly of the lamp 10, the assembled PCB 58 is connected to the holder 30 as shown in the exploded view of FIG. 3, such that the second contact flaps 71*b* of the contact path elements 70 come to rest on the contact surfaces 72 of the PCB 58.

In order to be able to establish a reliable solder connection, the holder 30 and the contact path elements 70 are pre-assembled with the length of the second section 70*b* designed for an interference fit, i. e. longer than necessary for an exact 90° bend between the first section 70*a* and second section 70*b* of the contact path elements 70. Thus, before assembly, the contact flaps 71*b* extend out of the holder 30 to protrude a small distance below. As the PCB 58 is fitted, a force acts longitudinally on the second section 70*b* of a contact path element 70, such that this section of the contact path elements 70 slides longitudinal within the guiding fit of the holder 30. Within the base 12, the holder 30 leaves a spring space 74 free, into which a third section 70*c* of the contact path elements is received as it is deflected by the force exerted on the second section 70*b* of the contact path elements 70.

By providing the mentioned oversize, slidable reception and spring space 74, a clamping fit of the contact flaps 71*b* on the contact surfaces 72 of the PCB 58 is achieved, where a spring force of the deflected third section 70*c* of the contact path elements 70 achieves a pressing force, pressing the contact flaps 71*b* onto the contact surfaces 72. Subsequently, the solder connection is made.

The holder 30 comprises an opening 45 which allows access to the contact flaps 71*b* and contact surfaces 72 for soldering.

As already mentioned, one of the contacts 62 provided at the connector 52 is an electrical ground contact, connected to electrical ground of the motor vehicle. As shown in FIGS. 6, 8, a contact spring 76 is provided in one piece with one of the contact path elements 70 serving as the electrical ground contact, the contact spring 76 being provided to establish an electrical ground connection to the metal housing 40.

The holder 30 includes an opening 78 provided within the top wall 38. The contact spring 76 is fixed to the holder 30 and extends through the opening 78 up to the metal housing 40.

As shown in the partial views of figs. 8, 9, the top surface 80 of the base 12 is a metal sheet element which is part of the metal housing 40 and is made from aluminum. A contact sheet element 82 is arranged flat underneath the top surface 80 of the metal housing 40 in close contact therewith. The contact sheet element 82 is a thin piece of sheet metal made from a steel material, considerably thinner than the aluminum sheet material of the top surface 80.

The burner holding ring 32 includes a flange 33 extending downwardly up to the top surface 80. The burner holding ring 32 is fixed to the base 12 by means of a crimping connection of the top surface 80 of the metal housing 40 with the flange 33. As shown in FIG. 9, the sandwich structure formed of the steel material of the contact sheet element 82 and the aluminum material of the top surface 80 of the metal housing 40 is bent at the central opening 28 for the burner 14 to surround the flange 33 of the burner holding ring 32. The thus formed crimping connection extends around the substantially circular opening 28 in the top surface 80 provided for the burner 14 and is effective to both fix the flange 33, and thereby the burner holding ring 32 to the top surface 80, and also to provide a close mechanical (and thereby also electrical) connection between the contact sheet element 82 and the top surface 80 of the metal housing 40.

As shown in FIG. 6, FIG. 8, the contact spring 76 provides two contact fingers 84 which bear against the lower surface of the contact sheet element 82 in a clamping fit. Thus, the electrical ground connection provided at the connector 52 is brought into electrical contact with the metal housing 40 via the contact spring 76 and the contact sheet element 82.

As already explained, the operating circuit 50 comprises an ignitor for igniting an electrical arc discharge within the discharge vessel 18. The ignitor includes an ignition transformer 54 as shown in FIG. 2, arranged within an insulation chamber 42 with side walls formed integrally with the holder 30. The ignition transformer 54 is embedded, for purposes of electrical insulation, within an insulation compound 43.

The insulation compound 43 is a silicone insulation compound, which is filled into the insulation chamber 42 in upside-down orientation, as e.g. shown in FIG. 6. The transformer 54 is placed within the insulation chamber 42, and the insulation compound 43 is filled into the chamber 42 in a liquid form. The holder 30 including the filled insulation chamber 42 is then placed into an oven for a heat curing treatment of the insulation compound 43, such that the insulation compound 43 solidifies.

During filling of the insulation chamber 42 in the upside-down orientation as shown in FIG. 6, any amounts of the liquid insulation compound 43 possibly leaking from the insulation chamber 42 into the interior of the holder 30 are retained by a retention wall 46 provided around the central opening 28. Thus, leaked amounts of the insulation compound 43 will not leak through the opening 28 onto the—in the upside-down orientation of FIG. 6—bottom surface of the holder 30, i.e. onto the top surface (in FIG. 2) of the base 12, exposed to heat and radiation from the burner 14. Thus, evaporation of silicone, and in particular silicone entering the front parts of the lamp 10 and the reflector, into which the lamp 10 will be mounted, is effectively prevented.

The central opening 28 in the top wall 38 of the holder 30, through which the burner 14 protrudes, is connected with a further opening in the top wall 38, through which the return contact 24 enters the base 12. The retention wall 46 is arranged to surround both openings. Further, the top wall 38 of the holder 30 includes, as already explained, an opening 78 for the ground contact spring 76. The opening 78, as shown in FIG. 8, is also surrounded by raised retention walls 48, extending, in the same way as the retention wall 46 around the central opening 28, perpendicularly from the top wall 38 of the holder 30. Thus, even larger amounts of leaked insulation compound 43 are safely retained within the holder 30 until the curing treatment. During the curing treatment, leaked compound 43 within the interior of the holder 30 will solidify as well, such that there is no further risk of silicone entering the front portions of the lamp 10.

Figure 10:
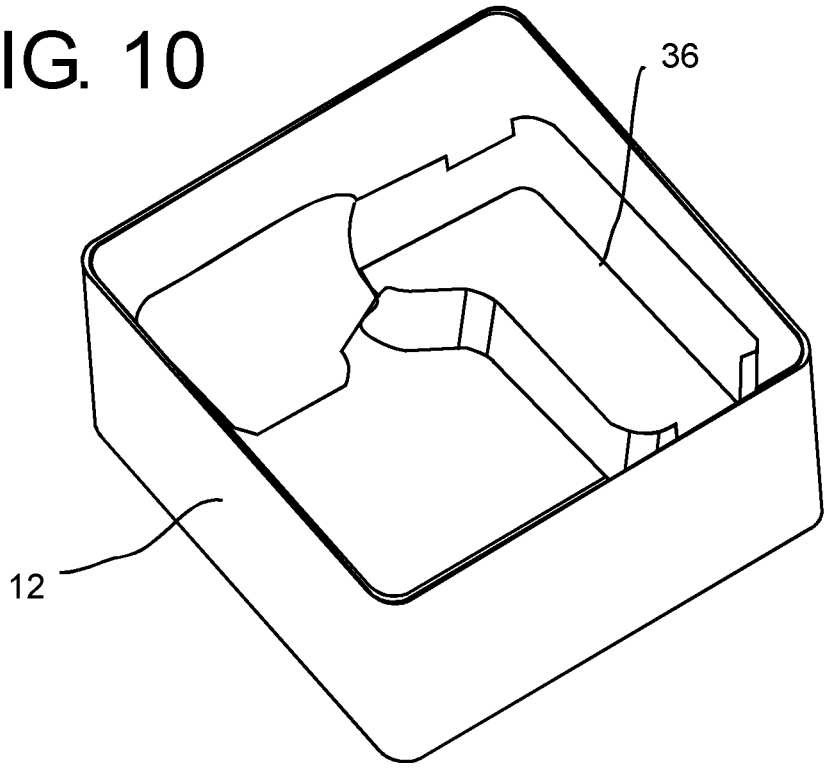
FIG. 10 shows a perspective view of parts of the lamp of FIG. 1-9, including an electromagnetic shield.

As shown in the figures, in particular FIG. 2, the packaging of electrical components and contacts within the base 12 is particularly dense, such that the distances between the electrical components are small. In order to reduce the risk of EMI, in particular from the ignitor components, such as the ignition transformer 54, a metal shield 36, as shown in FIG. 10, is arranged within the base 12. The metal shield 36 is arranged substantially in parallel to the top and bottom surfaces of the base 12, e.g. substantially horizontally, as shown e.g. in FIG. 2, FIG. 4. The metal shield 36 is arranged to partly cover the PCB 58, and in particular to separate components on the PCB 58 from the ignition transformer 54. Further, as shown in FIG. 2, the metal shield 36 is also arranged to partly shield the plug/socket connector 52 and the contact leads 70 from further components within the base 12, in order to prevent EMI from spreading within the base 12 via these connections.

While the invention has been illustrated and described in detail in the drawings and foregoing description, such illustration and description are to be considered illustrative or exemplary and not restrictive; the invention is not limited to the disclosed embodiments.

Variations of the disclosed embodiment can be understood and effected by those skilled in the art in practicing the claimed invention, from a study of the drawings, the disclosure and the appended claims. In the claims, the word "comprising" or "including" does not exclude other elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. Lamp comprising a burner fixed to a lamp base, where the lamp base comprises a housing element including a top wall element oriented towards said burner, where said top wall element comprises at least one opening, where said lamp base further comprises an insulation chamber, where an electrical component is embedded within an insulation compound, and where a raised retention wall is provided surrounding said opening, said raised retention wall extending from the top wall element into the housing element.

2. Lamp according to claim 1, where said top wall comprises a plurality of openings, where each of said openings is provided with a surrounding retention wall.

3. Lamp according to claim 1, where said housing element comprises a holder element comprising side walls of said insulation chamber.

4. Lamp according to claim 3, where said holder element further comprises said raised retention wall provided around said opening.

5. Lamp according to claim 1, where said housing element comprises a holder element made out of an electrically insulating material arranged within an outer metal housing.

6. Lamp according to claim 1, where said insulation compound is a silicone containing insulation compound.

7. Lamp according to claim 1, where said lamp base comprises an electronic operating circuit to supply electrical power to said burner.

8. Lamp according to claim 7, where a metal shield element is provided within said lamp base to shield electrical components or contacts of said electronic operating circuit.

9. Lamp according to claim 8, where said metal shield element is arranged between a transformer and/or coil component and further electronic components of said electronic operating circuit.

10. Lamp according to claim 8, where said housing element comprises a connector electrically connected to contact path elements extending within said housing element, where said metal shield element is arranged to at least partly cover said connector and/or said contact path elements.

11. Method of manufacturing a lamp, the method comprising:

providing a lamp base for a burner, said lamp base including a top wall oriented towards said burner, where said top wall comprises at least one opening, filling at least partially an insulation chamber within said lamp base with an insulation compound, thereby embedding an electrical component arranged within said insulation chamber, and providing a raised retention wall surrounding said opening, said raised retention wall extending from the top wall element into the housing element, thereby preventing said insulation compound spilled from said insulation chamber from leaking through said opening.

12. Method according to claim 11, further comprising holding the lamp base in an orientation with said top wall below said insulation chamber during said filling at least partially said insulation chamber.

13. Method according to claim 11, where said filling at least partially said insulation chamber comprises introducing said insulation compound into said insulation chamber in a fluid state, the method further comprising curing said insulation compound in a curing treatment.

* * * * *